US008632641B2

(12) United States Patent
Hu

(10) Patent No.: US 8,632,641 B2
(45) Date of Patent: Jan. 21, 2014

(54) HIGH-ALLOY COLD WORK DIE STEEL

(75) Inventor: Kaihua Hu, Zhejiang (CN)

(73) Assignee: Ningbo Hopesun New Material Co., Ltd., Ningbo (CN)

( * ) Notice: Subject to any disclaimer, the term of this patent is extended or adjusted under 35 U.S.C. 154(b) by 218 days.

(21) Appl. No.: 12/866,239

(22) PCT Filed: Sep. 21, 2009

(86) PCT No.: PCT/CN2009/001047

§ 371 (c)(1), (2), (4) Date: Aug. 5, 2010

(87) PCT Pub. No.: WO2010/045781

PCT Pub. Date: Apr. 29, 2010

(65) Prior Publication Data

US 2011/0002806 A1 Jan. 6, 2011

(30) Foreign Application Priority Data

Oct. 24, 2008 (CN) ..... 2008 1 0121969

(51) Int. Cl.
*C22C 37/06* (2006.01)
*C22C 38/36* (2006.01)
*C22C 38/00* (2006.01)

(52) U.S. Cl.
USPC ..... 148/324; 148/330; 420/10; 420/121

(58) Field of Classification Search
USPC ..... 420/10, 12, 64, 70, 100, 121, 127; 148/324, 325, 330
See application file for complete search history.

(56) References Cited

FOREIGN PATENT DOCUMENTS

| | | | |
|---|---|---|---|
| DE | 10039144 C1 | * | 11/2001 |
| JP | 61213348 A | * | 9/1986 |
| JP | 08100239 A | * | 4/1996 |

OTHER PUBLICATIONS

Mizuno et al., English machine translation of JP 08-100239, Apr. 16, 1996, whole document.*
Sudo et al., English machine translation of abstract of JP 61-213348, Sep. 22, 1986, p. 1 of 1.*
Sudo et al., English translation of JP 61-213348, Sep. 1986, whole document.*
Abdolreza et al., English machine translation of DE 10039144C1, Nov. 22, 2001, p. 1-9.*
International Search Report of PCT/CN2009/001047, Dec. 31, 2009.

* cited by examiner

*Primary Examiner* — Roy King
*Assistant Examiner* — Caitlin Kiechle
(74) *Attorney, Agent, or Firm* — Wang Law Firm, Inc.; Li K. Wang; Stephen Hsu

(57) ABSTRACT

The present invention encloses a kind of the high-alloy cold work die steel wherein the steel in wt % consisting of: C 1.0~2.5, Si≤1.3, Mn≤1.5, Cr 6.0~15.0, V≤2.5, B 0.01~0.4, and the balance is Fe with unavoidable impurities. The hardness and toughness of the die steel of the present invention are the same as Cr12MoV or Cr12Mo1V1, and even exceed them. And, the steel does not contain Mo with high price, the cost is lower than Cr12MoV or Cr12Mo1V1 accordingly, and the die steel of the present invention has a longer usage life, which is specially applied to make cold work moulds with high accuracy and long use life.

4 Claims, 2 Drawing Sheets

HIGH-ALLOY COLD WORK DIE STEEL

CROSS REFERENCE TO RELATED PATENT APPLICATION

The present application is the US national stage of PCT/CN2009/001047 filed on Sep. 21, 2009, which claims the priority of the Chinese patent application No. 200810121969.9 filed on Oct. 24, 2008, which application is incorporated herein by reference.

FIELD OF THE INVENTION

The die steel of the present invention is a kind of high carbon-chromium cold work die steel, which belongs to the category of the high-alloy cold work die steel.

DESCRIPTION OF THE PRIOR ART

The high-alloy cold work die steel is an optimum material for cold work moulds with high accuracy and long usage life, and the main steel-grades are Cr12, Cr12MoV and Cr12Mo1V1. Cr12 is the earliest High Carbon-Chromium Cold Work Die Steel and contains extremely high Carbon and Chromium, in which are C 2.0~2.3 wt % and Cr 11.0~13.0 wt %. Judged by metallurgical structure, it is ledeburite steel, which noticeable advantage is high hardenability, hardness and abrasion resistance. However, mass eutectic carbide exists in microstructure because Cr12 is ledeburite steel. Even after multipass upsetting and stretching deformation, the lumpiness of carbide is still large without uniform distribution, which cannot be improved through heat-treatment. Defective microstructure is the main weakness, and what is shown in mechanical properties is high hardness and insufficient toughness. The steel of Cr12 is only used to make cold work moulds without high demand of toughness. Cr12MoV is evolved based on Cr12 and still is ledeburite steel, but it has large improvement on chemistry compositions, which reduces the content of C and add the alloy element Mo and V, and the content of Mo and V is respectively 0.5 wt % and 0.3 wt %. It has further improvement on hardenability, less heat-treatment deformation and obvious reduction of eutectic carbide in metallurgical structure with better distribution, which changes the form from horn mass to round mass. Comparing with Cr12, the deficiency of microstructure has been almost relieved, what is shown in mechanical properties is high hardness with greatly improved toughness. This steel can be applied to make complicated and high accuracy cold work moulds. The content of C in Cr12Mo1V1 is slightly slipped comparing with Cr12MoV, and the contents of Mo and V reach about 1.0 wt %. The eutectic carbide is basically spheroidized after being deformation processed and heat-treatment. And the influence of carbide quantity, distribution and form to toughness of the material is minimized. The hardenability and abrasion resistance of Cr12Mo1V1 are further improved comparing with Cr12MoV. The steel of Cr12Mo1V1 is the die steel having the best properties among current kinds of the high carbon-chromium cold work steel.

The chemical composition and mechanical property of the above said Cr12, Cr12MoV and Cr12Mo1V1 are shown in Sheet 1.

Sheet 1 Chemical composition and mechanical property of Cr12, Cr12MoV and Cr12Mo1V1

| Steel | Chemical composition (wt %) | | | | | | Propertyies | |
|---|---|---|---|---|---|---|---|---|
| | | | | | | | Hardness | Toughness |
| Grade | C | Si | Mn | Cr | Mo | V | HRC | J/cm$^2$ |
| Cr12 | 2.0~2.3 | ≤0.40 | ≤0.40 | 11.5~13.0 | | | ≥60 | ≥12 |
| Cr12MoV | 1.45~1.70 | ≤0.40 | ≤0.40 | 11.0~12.5 | 0.4~0.6 | 0.15~0.3 | ≥58 | ≥20 |
| Cr12Mo1V1 | 1.40~1.60 | ≤0.60 | ≤0.60 | 11.0~13.0 | 0.70~1.20 | ≤1.10 | ≥58 | ≥30 |

SUMMARY OF THE INVENTION

The object of the present invention is to provide a kind of high-alloy cold work steel, of which the hardness and toughness are the same as Cr12MoV or Cr12Mo1V1, and even better than them, the composition of which does not include Mo, and the cost of which is lower than Cr12MoV or Cr12Mo1V1.

To achieve the above stated objects, the present invention provides a high-alloy cold work die steel wherein the steel in wt % consisting of:

C 1.0~2.5, Si≤1.3, Mn≤1.5, Cr 6.0~15.0, V≤2.5, B 0.01~0.4, and the balance is Fe with unavoidable impurities. And the preferential content of Si, Mn and V in wt % is Si0.01~1.3, Mn0.01~1.5 and V0.05~2.5

Preferably, the present invention high-alloy cold work die steel in wt % consisting of:

C 1.2~2.3, Si 0.1~1.0, Mn 0.1~1.2, Cr 7.0~13.89, V 0.05~2.05, B 0.02~0.30, and the balance is Fe with unavoidable impurities.

A further preferable high-alloy cold work die steel in wt % consisting of:

C 1.25~1.74, Si 0.25~0.6, Mn 0.19~0.33, Cr 11.0~13.0, V 0.40~1.03, B 0.08~0.15, and the balance is Fe with unavoidable impurities.

The effect of Boron is as below:

In general, Boron is supposed to have low solubility in carbon steel. For example, the solubility in austenite is less than 0.02 wt %, and the solubility in ferrite is less than 0.002 wt %. However, the research of the present invention demonstrates that it would noticeably enhance solubility of Boron in high temperature austenite when adding alloy elements into steel, especially when adding Cr over 6.0 wt %. The present invention makes use of this feature and adding higher content of Boron than the conventional content into high chrome steel, the highest content of Boron reaches 0.4 wt %, to gain maximum solubility of Boron in high temperature austenite.

There are two kinds of present form of Boron existing in the die steel of the present invention, that is, one is the solid solution Boron in the austenite or in the matrix, the other is the Boron compounds in primary compound (eutectic compound) and secondary compound (precipitated compound).

The solid solution Boron in matrix has following effects:

(1) The hardenability of the matrix can be improved;

(2) The martensite substructure can be refined and the toughness of the material can be improved;

(3) During annealing, the solid solution Boron is prior to induce the precipitation of the second compound, which raise the quantity of the second compound. Meanwhile, it ameliorates the form of Me (C, B) and improves the uniformity of the material;

(4) The solid solution Boron in the austenite can reduce the high temperature yielding strength, and can improve the ability of heat deformation of the material, which is able to abate cracks caused by rolling or forging and make rate of final products be raised.

The primary compound of Boron can improve the hardness and abrasive resistance of the material, but it is not benefit for the toughness and the heat deformation of the material.

Based on the two different effect of Boron as above stated, the content of Boron in the present invention should be in a suitable range.

The metallurgical structure of the high-alloy cold work die steel of the present invention is composed of primary compound $Me(C, B)_I$, secondary compound $Me(C, B)_{II}$ and martensite matrix. Inside, the primary compound $Me(C, B)_I$ is big round massive, and the secondary compound is globular and spotted particle as shown in FIG. 1. Compared with metallurgical structure of Cr12MoV, the obvious feather of the die steel of the present invention is that, the quantity of the secondary compound is obviously much more, the secondary compound is finer, and the distribution is more homogeneous.

The energy spectrum analysis indicates that, as shown in FIG. 2, the primary and secondary compounds in the metallurgical structure of the high-alloy cold work die steel of the present invention is the borocarbon compound, that is $Me(C, B)_I$ and $Me(C, B)_{II}$.

As the solid solution Boron is prior to induce the precipitation of the second compound, and the quantity of the second compound is much more and the secondary compound is finer, the uniformity of microstructure is extremely improved. Furthermore, the solid solution of Boron enhances hardenability of matrix and refines the martensite structure. As a result, after the high-alloy cold work die steel of the present invention is routine quenched and low temperature tempered, the toughness $a_k$ will reach 33 J/cm$^2$ when the hardness of the high-alloy cold work die steel reaches 61.5HRC. It exceeds the property of Cr12MoV and reaches the property of Cr12Mo1V1. After the die steel is treated with heat-treatment of vacuum quenching and low temperature tempering, the toughness $a_k$ will reach 60 J/cm$^2$ when the hardness of the die steel reaches 60HRC, as shown in Sheet 2 and Sheet 3.

The smelting method of the high-alloy cold work die steel of the present invention includes the following different methods:

(1) Smelting in an arc furnace→forging→annealing (2) Smelting in an arc furnace→ESR(electroslag remelting) →forging→annealing (3) Smelting in an arc furnace→refining in a LF furnace→ESR→forging→annealing (4) Smelting in an arc furnace→refining in a LF furnace→vacuum degassing→ESR →forging→annealing In the order of the above stated method (1) to method (4), the smelting quality and capability property of the die steel made through the latter method is better than that of the die steel made through the former method.

The element Boron and the content of it in the present invention are applied in the Cr12MoV and Cr12Mo1V1, it will bring the same effect and can further make the hardenability, hardness and toughness all improved.

Compared with the prior art, the present invention has following effects:

The hardness and toughness of the die steel of the present invention are the same as Cr12MoV or Cr12Mo1V1, and even better than them. And, the steel does not contain valued Mo, the cost is lower than Cr12MoV or Cr12Mo1V1 accordingly, and the die steel of the present invention has a longer usage life.

DETAILED DESCRIPTION OF THE PREFERRED EMBODIMENT

Figure 1:
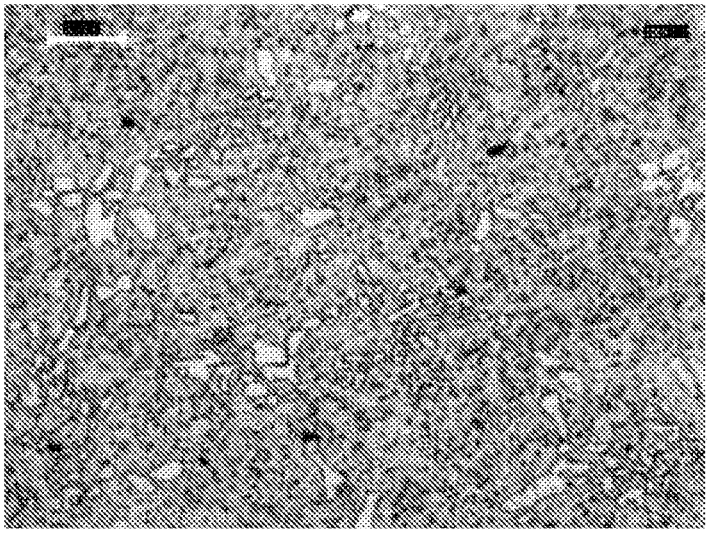
FIG. 1 is a metallurgical structure of the high-alloy cold work die steel in accordance with the embodiment of the present invention.
Figure 2:
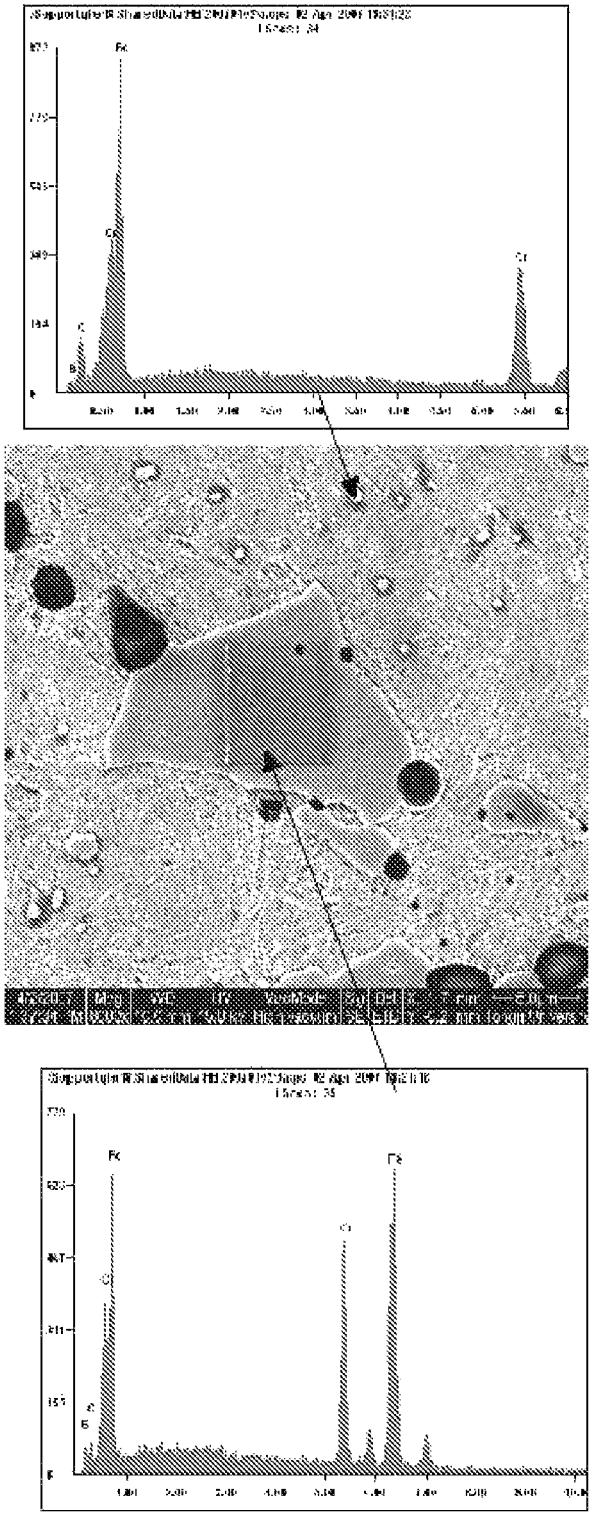
FIG. 2 is an energy spectrum of the metallurgical structure of the embodiment of the present invention.

To enable a further understanding of the innovative and technological content of the invention herein, refer to the detailed description of the invention and the accompanying drawings below:

Sheet 2 shows the chemical composition of the high-alloy cold work die steel of twenty-six embodiments of the present invention. (Sheet 2 does not show the balance of Fe and unavoidable impurities.) The method of the die steel of the present invention is as below:

Smelting in an arc furnace→ESR→forging→annealing, and heat-treatment of oil quenching at 1020° C. and tempering at 180° C.

The hardness and toughness of the die steel of said twenty-six embodiments after being oil quenched and tempered are shown in Sheet 2.

Sheet 2 Chemical composition, hardness and toughness of the high-alloy cold work die steel of the present invention

| | Chemical Composition (wt %) | | | | | | Properties | |
|---|---|---|---|---|---|---|---|---|
| | | | | | | | Hardness | Toughness |
| s/n | C | Si | Mn | Cr | V | B | HRC | $a_k$(J/cm$^2$) |
| 1 | 1.01 | 1.29 | 1.50 | 14.90 | 2.49 | 0.40 | 58.0 | 21.0 |
| 2 | 1.01 | 0.64 | 0.70 | 12.01 | 1.21 | 0.25 | 58.0 | 25.0 |
| 3 | 1.15 | 0.01 | 0.01 | 12.50 | 2.25 | 0.35 | 58.5 | 24.0 |
| 4 | 1.15 | 0.10 | 0.10 | 12.5 | 2.25 | 0.30 | 58.5 | 24.5 |
| 5 | 1.15 | 0.25 | 0.10 | 12.50 | 2.25 | 0.30 | 58.5 | 25.5 |
| 6 | 1.20 | 0.60 | 0.67 | 12.10 | 1.50 | 0.27 | 58.5 | 27.0 |
| 7 | 1.20 | 0.60 | 0.41 | 12.10 | 1.50 | 0.21 | 58.5 | 27.5 |
| 8 | 1.25 | 1.10 | 0.90 | 13.89 | 2.05 | 0.20 | 59.5 | 28.0 |
| 9 | 1.25 | 1.10 | 1.20 | 13.89 | 2.05 | 0.17 | 59.5 | 29.0 |
| 10 | 1.25 | 0.60 | 0.31 | 13.89 | 2.05 | 0.08 | 59.5 | 32.5 |
| 11 | 1.28 | 0.64 | 0.27 | 11.00 | 0.50 | 0.10 | 59.5 | 36.0 |
| 12 | 1.28 | 0.64 | 0.27 | 13.00 | 1.03 | 0.15 | 60.0 | 38.5 |
| 13 | 1.37 | 0.49 | 0.21 | 12.09 | 0.42 | 0.10 | 60.0 | 44.0 |
| 14 | 1.37 | 0.87 | 0.21 | 12.09 | 1.50 | 0.10 | 60.5 | 35.0 |
| 15 | 1.58 | 0.56 | 0.19 | 10.18 | 0.50 | 0.05 | 60.0 | 32.0 |
| 16 | 1.74 | 0.60 | 0.33 | 12.0 | 0.90 | 0.13 | 61.0 | 29.5 |
| 17 | 1.74 | 0.60 | 0.33 | 12.0 | 0.75 | 0.13 | 61.0 | 29.0 |
| 18 | 1.96 | 0.45 | 0.21 | 11.5 | 0.48 | 0.11 | 61.5 | 27.0 |
| 19 | 2.29 | 0.42 | 0.24 | 10.2 | 0.45 | 0.07 | 62.0 | 25.0 |
| 20 | 2.29 | 0.42 | 0.21 | 11.5 | 0.25 | 0.07 | 61.5 | 25.0 |
| 21 | 2.29 | 0.42 | 0.21 | 11.5 | 0.05 | 0.07 | 61.0 | 24.0 |
| 22 | 2.36 | 0.41 | 0.23 | 9.50 | 0.44 | 0.03 | 62.0 | 24.0 |
| 23 | 2.36 | 0.41 | 0.23 | 7.0 | 0.44 | 0.03 | 60.5 | 23.0 |
| 24 | 2.36 | 0.41 | 0.23 | 6.02 | 0.44 | 0.03 | 60.0 | 22.0 |
| 25 | 2.49 | 0.40 | 0.24 | 9.03 | 0.38 | 0.02 | 62.5 | 21.0 |
| 26 | 2.49 | 0.4 | 0.24 | 9.03 | 0.38 | 0.01 | 62.0 | 20.0 |

The hardness and toughness of some die steel in sheet 2 after being vacuum oil quenched at 1020° C. and tempered at 180° C. are shown in Sheet 3.

Sheet 3 Hardness and toughness of the die steel after being vacuum oil quenched at 1020° C. and tempered at 180° C.

| | Chemical Composition (wt %) | | | | | | Properties | |
|---|---|---|---|---|---|---|---|---|
| | | | | | | | Hardness | Toughness |
| s/n | C | Si | Mn | Cr | V | B | HRC | $a_k$(J/cm$^2$) |
| 10 | 1.25 | 0.60 | 0.31 | 13.89 | 2.05 | 0.08 | 59.5 | 52 |
| 11 | 1.28 | 0.64 | 0.24 | 11.00 | 0.50 | 0.10 | 59.5 | 54 |
| 13 | 1.37 | 0.49 | 0.21 | 12.09 | 0.42 | 0.10 | 60.0 | 60 |
| 17 | 1.74 | 0.60 | 0.33 | 12.0 | 0.75 | 0.13 | 61.0 | 48 |

It indicates that the heat-treatment of vacuum quenching is able to enhance the impact toughness of the die steel of the present invention effectively.

When a concave-convex punch mould made of the high-alloy cold work die steel of the present invention is used to cut a A3 steel plate in 4 mm thickness, the usage life of the concave-convex punch mould is longer than the moulds made of Cr12MoV or Cr12Mo1V1. The contrast of the usage life of them is shown in Sheet 4.

Sheet 4 Contrast of the Usage Life

| s/n | Die Steel | Type of Mould | Usage Life (Times) | Failure Type |
|---|---|---|---|---|
| 1 | The die steel of the present invention | Convex | 40000 | Not failure |

-continued

Sheet 4 Contrast of the Usage Life

| s/n | Die Steel | Type of Mould | Usage Life (Times) | Failure Type |
|---|---|---|---|---|
| | Cr12Mo1V1 | | 20000 | Wearing |
| | Cr12MoV | | 5000 | Tipping |
| 2 | The die steel of the present invention | Concave | 60000 | Not failure |
| | Cr12MoV | | 20000 | Wearing |

What is claimed is:

1. A high-boron-alloy cold work die steel wherein the steel in wt % consisting of:

C 1.0~2.5, Si≤1.3, Mn≤1.5, Cr 6.0~15.0, V≤2.5, B 0.01~0.4, and the balance is Fe with unavoidable impurities.

2. The high-boron-alloy cold work die steel of claim 1 wherein the content of Si, Mn and V in wt % is respectively as follows:

Si 0.01~1.3, Mn 0.01~1.5, V 0.05~2.5.

3. The high-boron-alloy cold work die steel of claim 2 wherein the steel in wt % consisting of:

C 1.2~2.3, Si 0.1~1.0, Mn 0.1~1.2, Cr 7.0~13.89, V 0.05~2.05, B 0.02~0.30, and the balance is Fe with unavoidable impurities.

4. The high-boron-alloy cold work die steel of claim 3 wherein the steel in wt % consisting of:

C 1.25~1.74, Si 0.25~0.6, Mn 0.19~0.33, Cr 11.0~13.0, V 0.42~1.03, B 0.1~1.15, and the balance is Fe with unavoidable impurities.

* * * * *